US006036533A

United States Patent [19]

Huang

[11] Patent Number: 6,036,533

[45] Date of Patent: Mar. 14, 2000

[54] SET OF HARNESSES FOR INTERCONNECTING A PLURALITY OF ORNAMENTAL LIGHT FIXTURES IN A VEHICLE

[75] Inventor: Nan Huang Huang, Rancho Palos Verdes, Calif.

[73] Assignee: Grand General Accessories Manufacturing Inc., Compton, Calif.

[21] Appl. No.: 09/212,488

[22] Filed: Dec. 16, 1998

[51] Int. Cl.[7] ..... H01R 11/00

[52] U.S. Cl. ..... 439/502; 439/623

[58] Field of Search ..... 439/502–505, 439/34–36, 651–653, 655, 623

[56] References Cited

U.S. PATENT DOCUMENTS

| | | | |
|---|---|---|---|
| 4,477,801 | 10/1984 | Robinson, Jr. et al. | 439/623 |
| 5,096,433 | 3/1992 | Boundy | 439/505 |
| 5,518,418 | 5/1996 | Larabell | 439/623 |

*Primary Examiner*—Michael L. Gellner
*Assistant Examiner*—Briggitte R. Hammond
*Attorney, Agent, or Firm*—Thomas I. Rozsa; Tony D. Chen; Jerry Fong

[57] ABSTRACT

A set of wire harnesses which are used for the interconnection of a plurality of light fixtures, for example, ornamental light fixtures, turn signal lights, marker lights and etc., for vehicles. These wire harnesses can be quickly connected or disconnected as a unit at plugging junctions.

2 Claims, 4 Drawing Sheets

SET OF HARNESSES FOR INTERCONNECTING A PLURALITY OF ORNAMENTAL LIGHT FIXTURES IN A VEHICLE

BACKGROUND OF THE INVENTION

1. Field of the Invention

The present invention generally relates to the field of vehicle accessories. More particularly, the present invention relates to the field of wire harnesses for the interconnection of a plurality of light fixtures, e.g., turn signal lights, marker lights and etc., for vehicles.

2. Description of the Prior Art

Generally, most prior art vehicle light fixtures are usually installed by the manufacturers and are electrically interconnected in advance in a vehicle. These light fixtures are typically connected by a main wire harness having a plurality of branch wires branched-off from a primary wire bundle. Each branch wire has a connector or plug for connecting to a particular light fixture. One problem with prior art wire harnesses is that they are specifically designed and arranged to interconnected a certain amount of vehicle light fixtures on a vehicle, and thereby not allowing a person to add additional vehicle light fixtures onto the vehicle. Furthermore, to add additional vehicle light fixtures, a person usually has to add additional wiring to the main wire harness by slicing the main wire harness to add the additional wires to connected the additional vehicle light fixtures.

It is desirable to have a very efficient and also very effective design and construction of a set of wire harnesses for interconnecting any desired number of vehicle light fixtures on a vehicle, with the capability of adding additional vehicle light fixtures to the main wire harness in a much more efficient way.

SUMMARY OF THE INVENTION

The present invention is a novel and unique set of wire harnesses for the interconnection of a plurality of light fixtures, for example, ornamental light fixtures, turn signal lights, marker lights and etc., for vehicles. Each light fixture has a connector base means with two or more female sockets.

The set of wire harnesses include four types of wire harnesses. These wire harnesses can be quickly connected or disconnected as a unit at plugging junctions.

In the preferred embodiment of the present invention, the set of wire harnesses include a first type of wire harnesses, a second type of wire harnesses, and a third type of wire harnesses. Each first type of wire harness comprises two terminal contacts, a male connector, and conducting wires connecting the terminal contacts to the male connector. The terminal contacts are adapted for respective connection to a power source. The male connector of each first type of wire harness has two male prongs. Each second type of wire harness comprises two configurations. The first configuration includes a pair of male connectors, a female connector, and conducting wires connecting the male and female connectors. The second configuration includes a pair of female connectors, a male connector, and conducting wires connecting the male and female connectors. Each of the male connectors of the first and second configurations of each second type of wire harness has two male prongs. Each of the female connectors of the first and second configurations of each second type of wire harness has two corresponding sockets. Each third type of wire harness comprises two male connectors and conducting wires connecting the two male connectors. Each male connector of each third type of wire harness has two male prongs.

In an alternative embodiment of the present invention, the set of wire harnesses include a first type of wire harnesses, a second type of wire harnesses, and a third type of wire harnesses. Each first type of wire harness comprises three terminal contacts, a male connector, and conducting wires connecting the terminal contacts to the male connector. The terminal contacts are adapted for respective connection to a power source. The male connector of the first type of wire harness has three male prongs. Each second type of wire harness comprises two configurations. The first configuration includes a pair of male connectors, a female connector, and conducting wires connecting the male and female connectors. The second configuration includes a pair of female connectors, a male connector, and conducting wires connecting the male and female connectors. Each of the male connectors of the first and second configurations of each second type of wire harness has three male prongs. Each of the female connectors of the first and second configurations of each second type of wire harness has three corresponding sockets. Each third type of wire harness comprises two male connectors and conducting wires connecting the two male connectors. Each male connector of the third type of wire harness has three male prongs.

It is an object of the present invention to provide a set of wire harnesses for interconnecting any desired of number vehicle light fixtures on a vehicle, with the capability of adding additional vehicle light fixtures to a main wire harness.

In another alternative embodiment, the present invention set of wire harnesses comprise a first type of wire harness, a second type of wire harness, and a third type of wire harness. The first type of wire harness comprises a male connector with a pair of male prongs, a pair of male terminal plugs, a pair of female terminal sockets, a first pair of electrical wires electrically connecting the male prongs to the male terminal plugs, and a second pair of electrical wires electrically connecting the male prongs to the female terminal sockets. The second type of wire harness comprises a male connector with a pair of male prongs, two pairs of male terminal plugs, and two pairs of electrical wires electrically connecting the male prongs to the male terminal plugs. The third type of wire harness comprises a male connector with a pair of male prongs, two pairs of female terminal sockets, and two pairs of electrical wires electrically connecting the male prongs to the female terminal sockets.

In a further alternative embodiment, the present invention set of wire harnesses comprise a first type of wire harness, a second type of wire harness, and a third type of wire harness. The first type of wire harness comprises a male connector with three male prongs, three male terminal plugs, three female terminal sockets, a first group of electrical wires electrically connecting the male prongs to the male terminal plugs, and a second group of electrical wires electrically connecting the male prongs to the female terminal sockets. The second type of wire harness comprises a male connector with three male prongs, a pair of three male terminal plugs, and a pair of three electrical wires electrically connecting the male prongs to the male terminal plugs. The third type of wire harness comprises a male connector with three male prongs, a pair of three female terminal sockets, and a pair of three electrical wires electrically connecting the male prongs to the female terminal sockets.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
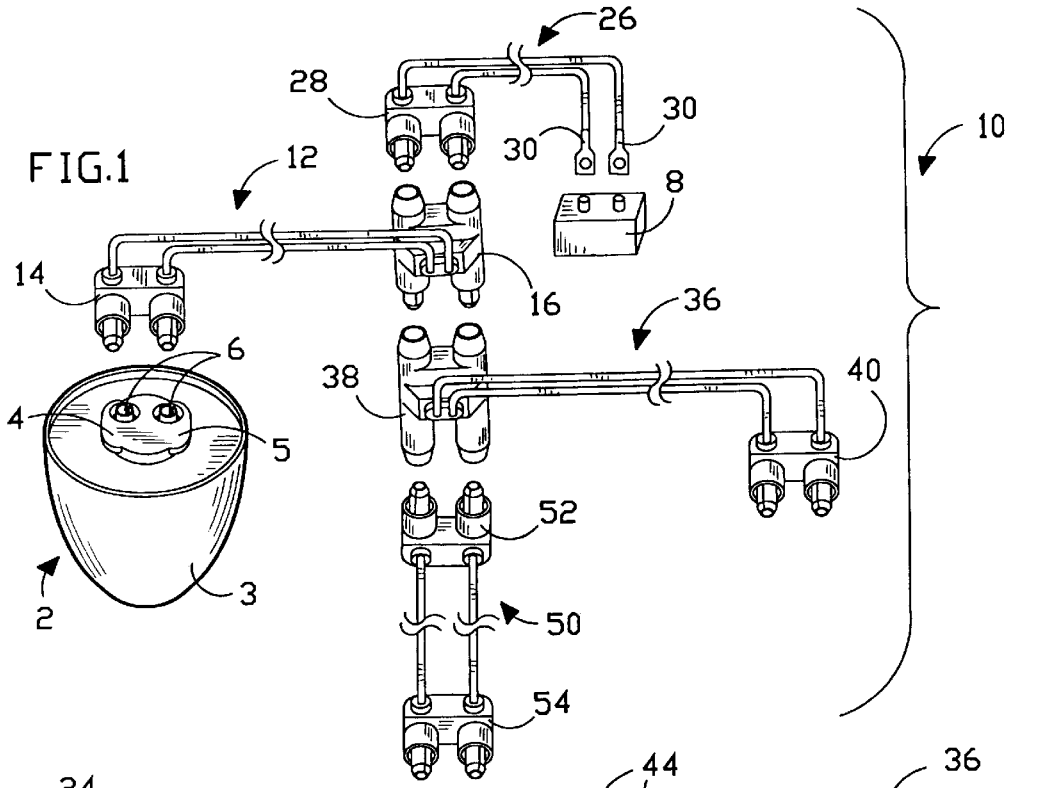
FIG. 1 is an exploded perspective view of the preferred embodiment of the present invention set of wire harnesses for interconnecting any desired number of vehicle light fixtures having at least two prongs or sockets.

Referring to FIG. 1, there is depicted at 10 a preferred embodiment of the present invention set of wire harnesses for the interconnection of a plurality of vehicle light fixtures 2 (only one is shown) on a vehicle (not shown), such as a truck, trailer or etc. Each light fixture 2 has a generally dome-shaped lens 3 and a base 4 permanently affixed to the open end of the dome-shaped lens 3. A connector means 5 is adapted to be permanently affixed to the base 4 and has a pair of female sockets 6.

Figure 2:
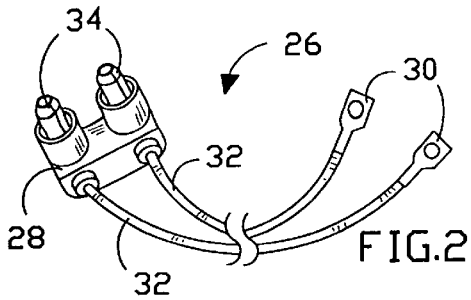
FIG. 2 is a perspective view of a first type of wire harness of the present invention set of wire harnesses.

Referring to FIGS. 1 and 2, there is depicted a first type of wire harness 26 which comprises a male connector 28, a pair of terminal contacts 30, and a pair of electrical wires 32 electrically connecting the male connector 28 to the pair of terminal contacts 30. The male connector 28 has a pair of male prongs 34. The pair of terminal contacts 30 are adapted for respectively connecting to a power source 8.

Figure 3:
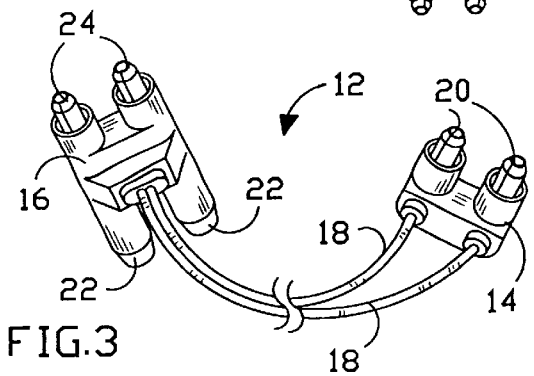
FIG. 3 is a perspective view of a first arrangement of a second type of wire harness of the present invention set of wire harnesses.

Referring to FIGS. 1 and 3, there is depicted a first arrangement 12 of a second type of wire harness which comprises a male connector 14, a male/female connector 16, and a pair of electrical wires 18 electrically connecting the male connector 14 to the male/female connector 16. The male connector 14 has a pair of male prongs 20 for respectively interconnecting to the pair of female sockets 6 of the vehicle light fixture 2. The male/female connector 16 has a pair of female sockets 22 and a pair of opposite male prongs 24. The male prongs 34 of the male connector 28 of the first type of wire harness 26 are connected to the female sockets 22 of the male/female connector 16 of the first configuration 12 of the second type of wire harness.

Figure 4:
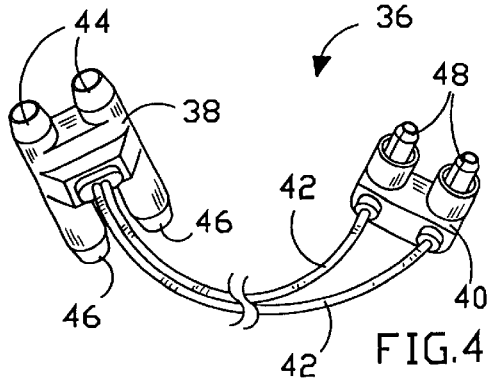
FIG. 4 is a perspective view of a second arrangement of the second type of wire harness of the present invention set of wire harnesses.

Referring to FIGS. 1 and 4, there is depicted a second configuration 36 of the second type of wire harness which comprises a female connector 38, a male connector 40, and a pair of electrical wires 42 electrically connecting the female connector 38 to the male connector 40. The female connector 38 has two pairs of opposite female sockets 44 and 46, wherein one pair 44 of the two pairs of female sockets are respectively interconnected to the pair of male prongs 24 of the male/female connector 16. The male connector 40 has a pair of male prongs 48 which are adapted for respectively interconnecting to the pair of female sockets 6 of another one of the plurality of vehicle at light fixtures 2.

Figure 5:
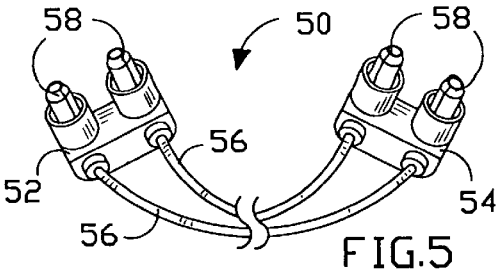
FIG. 5 is a perspective view of a third type of wire harness of the present invention set of wire harnesses.

Referring to FIGS. 1 and 5, there is depicted a third type of wire harness 50 which comprises two male connectors 52 and 54, and a pair of electrical wires 56 electrically connecting the two male connectors 52 and 54. Each connector has a pair of male prongs 58, wherein the pair of the male prongs 58 of the male connector 52 are respectively interconnected to the other pair 46 of the two pairs of female sockets of the female connector 38 of the second arrangement 36 of the second type of wire harness. The pair of the male prongs 58 of the male connector 54 are adapted for respectively interconnecting to the pair of female sockets 6 of still another one of the plurality of vehicle light fixtures 2.

It will be appreciated that the present invention is not confined to the particular arrangement shown in FIG. 1. It is emphasized that while the arrangement shown in FIG. 1 is preferred, it is also within the spirit and scope of the present invention to utilized additional wire harnesses shown in FIGS. 2 through 5 to connect additional vehicle light fixtures. By adding the correct wire harnesses which are shown in FIGS. 2 through 5, the additional vehicle light fixtures can be bridged or linked to a main wire harness which is connected to the power source, thereby eliminating the need to splice the main wire harness to add additional wiring for the additional vehicle light fixtures.

It will be appreciated that the present invention is not limited to the male and female connector arrangements shown in the first, second, and third types of wire harnesses. It is also within the spirit and scope of the present invention to utilize any combination of male and female connector arrangements in the first, second and third types of wire harnesses.

Figure 6:
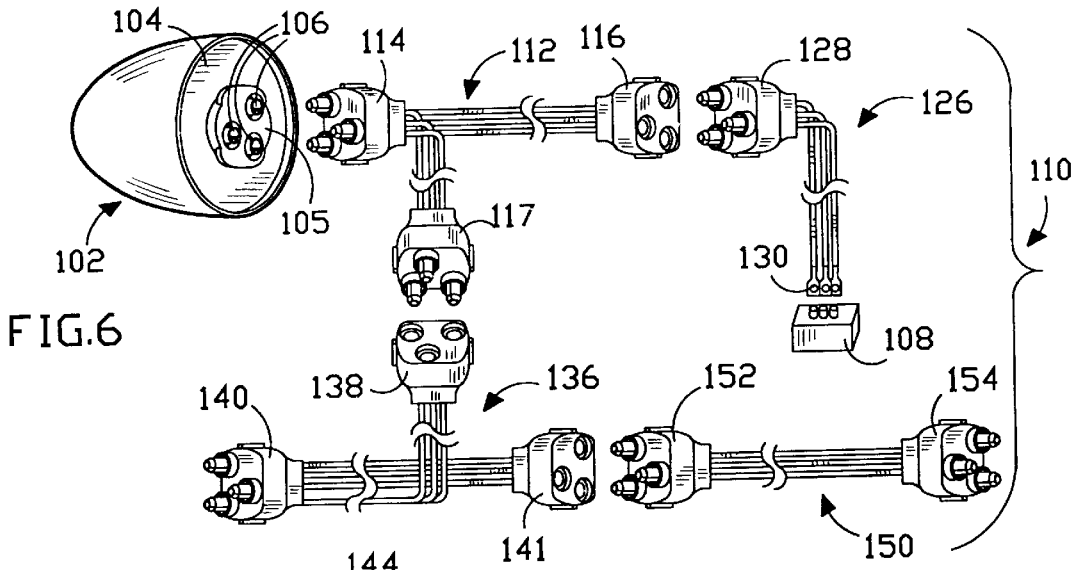
FIG. 6 is an exploded perspective view of an alternative embodiment of the present invention set of wire harnesses for interconnecting any desired number of vehicle light fixtures having at least three prongs or sockets.

Referring to FIG. 6, there is depicted at 110 an alternative embodiment of the present invention set of wire harnesses for the interconnection of a plurality of vehicle light fixtures 102 (only one is shown) on a vehicle (not shown), such as a truck, trailer or etc. Each light fixture 102 has a generally dome-shaped lens 103 and a base 104 permanently affixed to the open end of the dome-shaped lens 103. A connector means 105 is adapted to be permanently affixed to the base 104 and has three female sockets 106.

Figure 7:
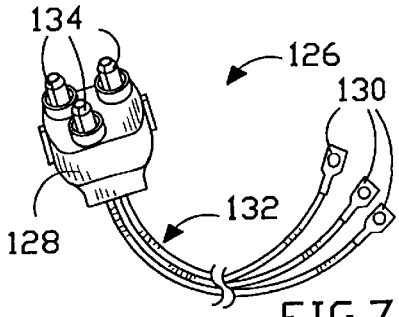
FIG. 7 is a perspective view of a first type of wire harness of the present invention shown in FIG. 6.

Referring to FIGS. 6 and 7, there is depicted a first type of wire harness 126 which comprises a male connector 128, three terminal contacts 130, and three electrical wires 132 electrically connecting the male connector 128 to the three terminal contacts 130. The male connector 128 has three male prongs 134. The three terminal contacts 130 are adapted for respectively connecting to a power source 108.

Figure 8:
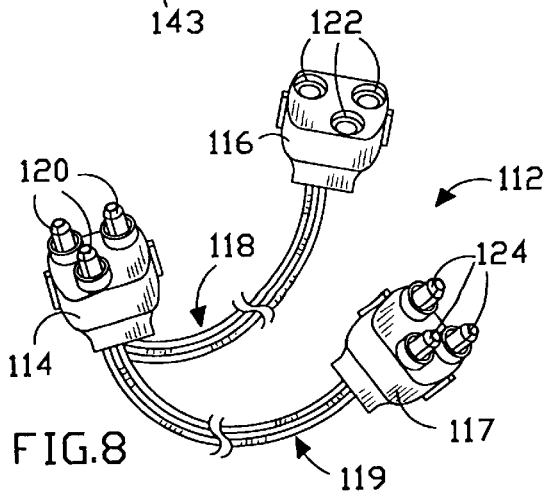
FIG. 8 is a perspective view of a first arrangement of a second type of wire harness of the present invention shown in FIG. 6.

Referring to FIGS. 6 and 8, there is depicted a first configuration of a second type of wire harness 112 which comprises two male connectors 114 and 117, a female connector 116, a first group of three electrical wires 118 electrically connecting the male connector 114 to the female connector 116, and a second group of three electrical wires 119 electrically connecting the male connectors 114 and 117. The male connector 114 has three male prongs 120 for respectively interconnecting to the three female sockets 106 of the vehicle light fixture 102. The female connector 116 has three female sockets 122 thereto, while the male connector 117 has three male prongs 124.

Figure 9:
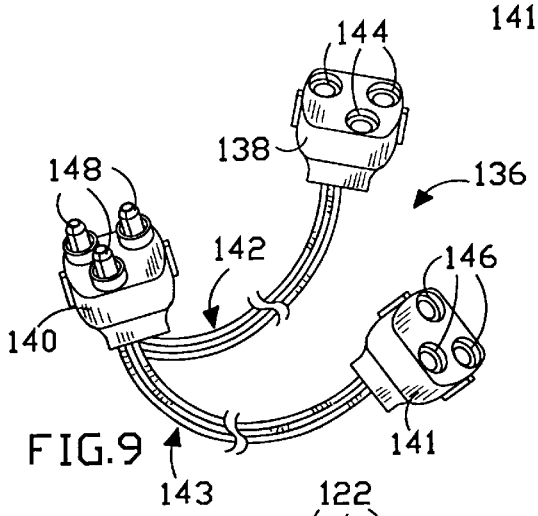
FIG. 9 is a perspective view of a second arrangement of the second type of wire harness of the present invention shown in FIG. 6.

Referring to FIGS. 6 and 9, there is depicted a second configuration of the second type of wire harness 136 which comprises two female connectors 138 and 141, a male connector 140, a first group of three electrical wires 142 electrically connecting the female connector 138 to the male connector 140, and a second group of three electrical wires 143 electrically connecting the male connector 140 to the female connector 141. The male connector 140 has three male prongs 148 which are adapted for respectively interconnecting to the three female sockets 106 of another one of the plurality of vehicle light fixtures 102. The female connector 138 has three female sockets 144 which are respectively received and interconnected to the three male prongs 124 of the male connector 117. The female connector 141 also has three female sockets 146.

Figure 10:
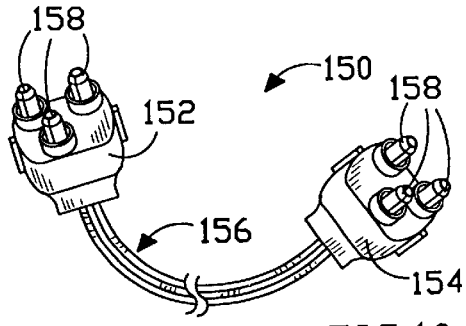
FIG. 10 is a perspective view of a third type of wire harness of the present invention shown in FIG. 6.

Referring to FIGS. 1 and 10, there is depicted a third type of wire harness 150 which comprises two male connectors 152 and 154, and three electrical wires 156 electrically connecting the two male connectors 152 and 154. Each connector has three male prongs 158, wherein the three male prongs 158 of the male connector 152 are respectively interconnected to the three female sockets 146 of the female connector 141 of the second configuration 136 of the second type of wire harness. The three male prongs 158 of the other male connector 154 are adapted for respectively interconnecting to the three female sockets 106 of still another one of the plurality of vehicle light fixtures 102.

It will be appreciated that the present invention is not confined to the particular arrangement shown in FIG. 6. It is emphasized that while the arrangement shown in FIG. 6 is preferred, it is also within the spirit and scope of the present invention to utilized additional wire harnesses shown in FIGS. 7 through 10 to connect additional vehicle light fixtures. By adding the correct wire harnesses which are shown in FIGS. 7 through 10, the additional vehicle light fixtures can be bridged or linked to a main wire harness which is connected to the power source, thereby eliminating the need to splice the main wire harness to add additional wiring for the additional vehicle light fixtures.

It will be appreciated that the present invention is not limited to the male and female connector arrangements shown in the first, second, and third types of wire harnesses. It is also within the spirit and scope of the present invention to utilize any combination of male and female connector arrangements in the first, second and third types of wire harnesses.

The present invention conforms to conventional forms of manufacture or any other conventional way known to one skilled in the art, and is of simple construction and is easy to use.

Figure 11:
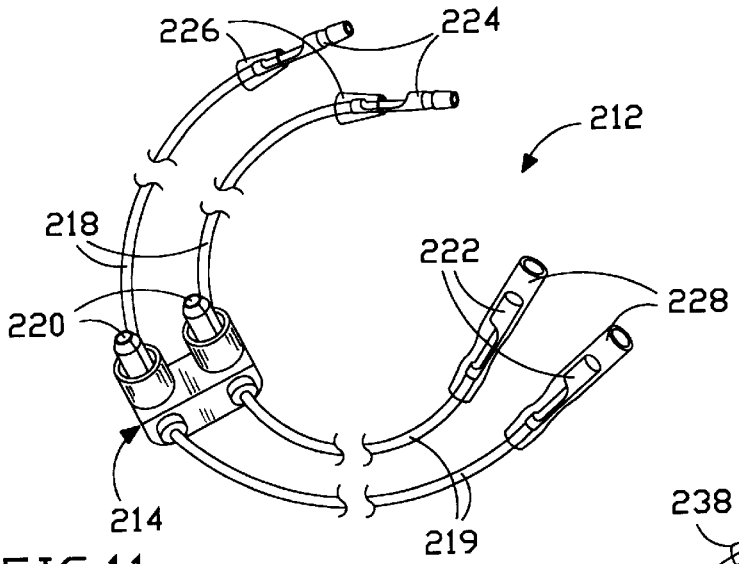
FIG. 11 is a perspective view of another alternative embodiment of the present invention set of wire harnesses, showing a first type of wire harness.
Figure 12:
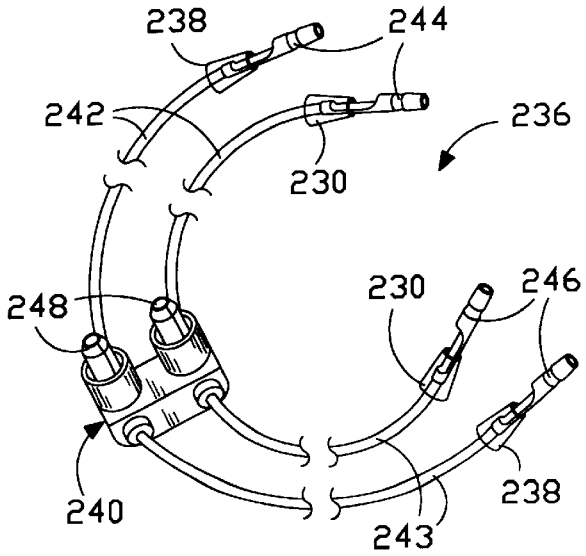
FIG. 12 is a perspective view of a second type of wire harness of the present invention set of wire harnesses.
Figure 13:
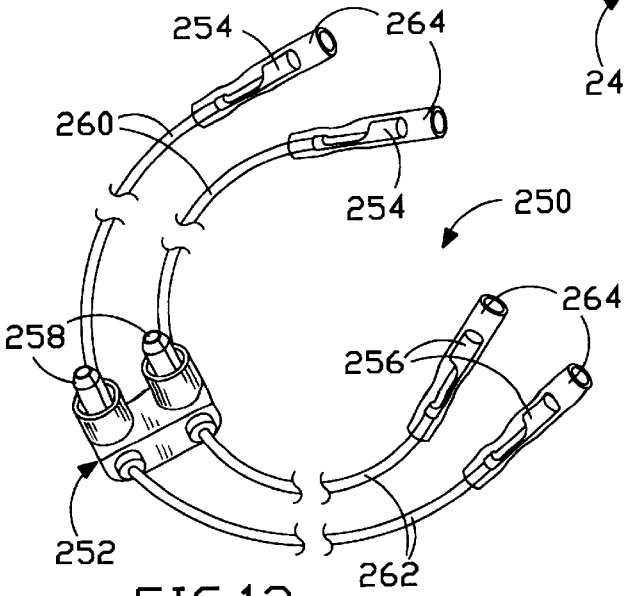
FIG. 13 is a perspective view of a third type of wire harness of the present invention set of wire harnesses.

Referring to FIGS. 11, 12 and 13, there are shown another alternative embodiment of the present invention set of wire harnesses which includes a first type of wire harness 212, a second type of wire harness 236, and a third type of wire harness 250.

Referring to FIG. 11, there is depicted at 212 the first type of wire harness which comprises a male connector 214 with a pair of male prongs 220, a pair of male terminal plugs 224, a pair of female terminal sockets 222, and a first pair of insulated electrical wires 218 electrically connecting the pair of male prongs 220 to the pair of male terminal plugs 224, and a second pair of insulated electrical wires 219 electrically connecting the pair of male prongs 220 to the pair of female terminal sockets 222. The male terminal plugs 224 are partially covered by insulated material 226 while the female terminal sockets 222 are completely covered by insulated material 228. The pair of male prongs 220 of the male connector 214 may be respectively interconnected to a pair of female sockets 6 of the vehicle light fixture 2 (see FIG. 1).

Referring to FIG. 12, there is depicted at 236 the second type of wire harness of which comprises a male connector 240 with a pair of male prongs 248, a first pair of male terminal plugs 244, a second pair of male terminal plugs 246, and a first pair of insulated electrical wires 242 electrically connecting the pair of male prongs 248 to the first pair of male terminal plugs 244, and a second pair of insulated electrical wires 243 electrically connecting the pair of male prongs 248 to the second pair of male terminal plugs 246. The male terminal plugs 244 and 246 are partially covered by insulated material 238.

The pair of male prongs 248 of the male connector 214 may be respectively interconnected to the pair of female sockets 6 of another one of the vehicle light fixture 2 (see FIG. 1). The male terminal plugs 244 and 246 may be interconnected to the female terminal sockets 222 (see FIG. 11) for extending and interconnecting any desired number of vehicle light fixtures on a vehicle, with the capability of adding additional vehicle light fixtures to a main wire harness (not shown).

Referring to FIG. 13, there is depicted at 250 the third type of wire harness of which comprises a male connector 252 with a pair of male prongs 258, a first pair of female terminal sockets 254, a second pair of female terminal sockets 256, and a first pair of insulated electrical wires 260 electrically connecting the pair of male prongs 258 to the first pair of female terminal sockets 254, and a second pair of insulated electrical wires 262 electrically connecting the pair of male prongs 258 to the second pair of female terminal sockets 256. The female terminal sockets 254 and 256 are completely covered by insulated material 264.

The pair of male prongs 258 of the male connector 252 may be respectively interconnected to the pair of female sockets 6 of another one of the vehicle light fixture 2 (see FIG. 1). The female terminal sockets 254 and 256 may be interconnected to the male terminal plugs 224, 244 and 246 (see FIGS. 11 and 12) for extending and interconnecting any desired number of vehicle light fixtures on a vehicle, with the capability of adding additional vehicle light fixtures to the main wire harness.

By adding the correct wire harnesses which are shown in FIGS. 11 through 13, the additional vehicle light fixtures can be bridged or linked to the main wire harness which is connected to the power source, thereby eliminating the need to splice the main wire harness to add additional wiring for the additional vehicle light fixtures.

It will be appreciated that the present invention is not confined to the particular arrangement shown in FIGS. 11, 12 and 13. It is emphasized that while the arrangement shown in FIGS. 11, 12 and 13 are preferred, it is also within the spirit and scope of the present invention to have a female connector with a pair of female sockets and different arrangement of the male terminal plugs and the female terminal sockets.

Figure 14:
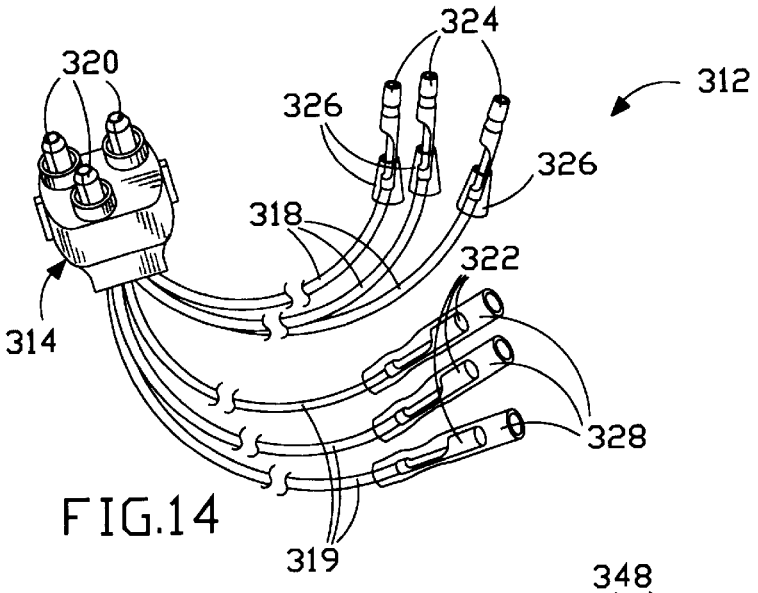
FIG. 14 is a perspective view of a further alternative embodiment of the present invention set of wire harnesses, showing a first type of wire harness.
Figure 15:
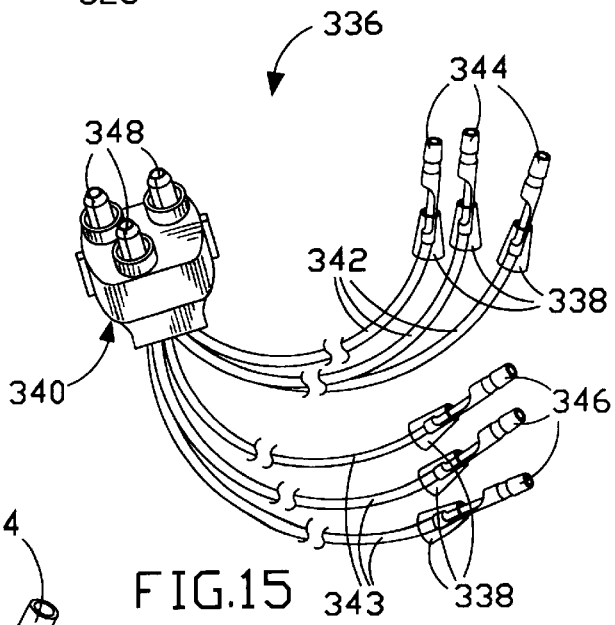
FIG. 15 is a perspective view of a second type of wire harness of the present invention set of wire harnesses.
Figure 16:
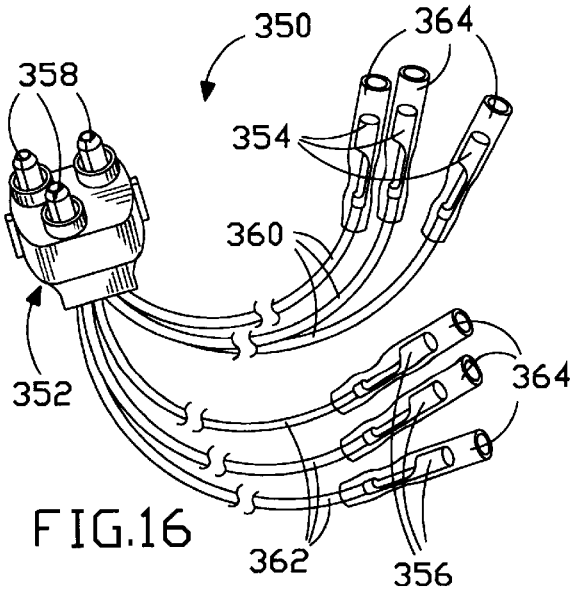
FIG. 16 is a perspective view of a third type of wire harness of the present invention set of wire harnesses.

Referring to FIGS. 14, 15 and 16, there are shown a further alternative embodiment of the present invention set of wire harnesses which includes a first type of wire harness 312, a second type of wire harness 336 and a third type of wire harness 350.

Referring to FIG. 14, there is depicted at 312 the first type of wire harness which comprises a male connector 314 with three male prongs 320, three male terminal plugs 324, three female terminal sockets 322, and a first group of insulated electrical wires 318 electrically connecting the three male prongs 320 to the three male terminal plugs 324, and a second group of insulated electrical wires 319 electrically connecting the three male prongs 320 to the three female terminal sockets 322. The male terminal plugs 324 are partially covered by insulated material 326 while the female terminal sockets 322 are completely covered by insulated material 228. The male prongs 320 of the male connector 214 may be respectively interconnected to female sockets 106 of the vehicle light fixture 102 (see FIG. 6).

Referring to FIG. 15, there is depicted at 336 the second type of wire harness of which comprises a male connector 340 with three male prongs 348, a first group of male terminal plugs 344, a second group of male terminal plugs 346, and a first group of insulated electrical wires 342 electrically connecting the three male prongs 348 to the first group of male terminal plugs 344, and a second group of insulated electrical wires 343 electrically connecting the pair of male prongs 348 to the second group of male terminal plugs 346. The male terminal plugs 344 and 346 are partially covered by insulated material 338.

The three male prongs 348 of the male connector 340 may be respectively interconnected to female sockets 106 of another one of the vehicle light fixture 102 (see FIG. 6). The male terminal plugs 344 and 346 may be interconnected to the female terminal sockets 322 (see FIG. 14) for extending and interconnecting any desired number of vehicle light fixtures on a vehicle, with the capability of adding additional vehicle light fixtures to a main wire harness (not shown).

Referring to FIG. 16, there is depicted at 350 the third type of wire harness of which comprises a male connector 352 with three male prongs 358, a first group of female terminal sockets 354, a second group female terminal sockets 356, and a first group of insulated electrical wires 360 electrically connecting the three male prongs 358 to the first group of female terminal sockets 354, and a second group of insulated electrical wires 362 electrically connecting the three male prongs 358 to the second group of female terminal sockets 356. The female terminal sockets 354 and 356 are completely covered by insulated material 364.

The male prongs 358 of the male connector 352 may be respectively interconnected to the female sockets 106 of another one of the vehicle light fixture 102 (see FIG. 6). The female terminal sockets 354 and 356 may be interconnected to the male terminal plugs 324, 344 and 346 (see FIGS. 14 and 15) for extending and interconnecting any desired number of vehicle light fixtures on a vehicle, with the capability of adding additional vehicle light fixtures to the main wire harness.

By adding the correct wire harnesses which are shown in FIGS. 14 through 16, the additional vehicle light fixtures can be bridged or linked to the main wire harness which is connected to the power source, thereby eliminating the need to splice the main wire harness to add additional wiring for the additional vehicle light fixtures.

It will be appreciated that the present invention is not confined to the particular arrangement shown in FIGS. 14, 15 and 16. It is emphasized that while the arrangement shown in FIGS. 14, 15 and 16 are preferred, it is also within the spirit and scope of the present invention to have a female connector with female sockets and different arrangement of the male terminal plugs and the female terminal sockets.

The present invention conforms to conventional forms of manufacture or any other conventional way known to one skilled in the art, and is of simple construction and is easy to use.

Defined in detail, the present invention is a set of wire harnesses for the interconnection of a plurality of vehicle light fixtures, each vehicle light fixture having a female connector base thereon, the set of wire harnesses comprising: (a) t least one first type of wire harness having a male connector with a pair of male prongs, a pair of male terminal plugs, a pair of female terminal sockets, and conducting wires electrically connecting to the pair of male prongs with the pair of male terminal plugs and the pair of female terminal sockets respectively, the pair of male prongs adapted for respective connection to the female connector base of one of the plurality of vehicle light fixtures; (b) at least one second type of wire harness having a male connector with a pair of male prongs, a first pair of male terminal plugs, a second pair of male terminal plugs, and conducting wires electrically connecting the pair of male prongs of the at least one second type of wire harness with the first and second male terminal plugs respectively, the pair of male prongs of the male connector adapted for respective connection of the female connector base of another one of the plurality of vehicle light fixtures, the first pair of male terminal plugs adapted for respective connection of the pair of female terminal sockets of the at least one first type of wire harness; and (c) at least one third type of wire harness having a male connector with a pair of male prongs, a first pair of female terminal sockets, a second pair of female terminal sockets, and conducting wires electrically connecting the pair of male prongs with the first and second female terminal sockets respectively, the pair of male prongs of the male connector adapted for respective connection to the female connector base of another one of the plurality of vehicle light fixture, the first pair of female terminal sockets adapted for respective connection of the second pair of male terminal plugs of the at least one second type of wire harness.

Alternatively defined in detail, the present invention is a set of wire harnesses for the interconnection of a plurality of vehicle light fixtures, each vehicle light fixture having a female connector base thereon, the set of wire harnesses comprising: (a) at least one first type of wire harness having a male connector with three male prongs, three male terminal plugs, three female terminal sockets, and conducting wires electrically connecting to the three male prongs with the three male terminal plugs and the three female terminal sockets respectively, the three male prongs adapted for respective connection to the female connector base of one of the plurality of vehicle light fixtures; (b) at least one second type of wire harness having a male connector with three male prongs, a first group of male terminal plugs, a second group of male terminal plugs, and conducting wires electrically connecting the three male prongs of the at least one second type of wire harness with the first and second groups of male terminal plugs respectively, the three male prongs of the male connector adapted for respective connection of the female connector base of another one of the plurality of vehicle light fixtures, the first group of male terminal plugs adapted for respective connection of the female terminal sockets of the at least one first type of wire harness; and (c) at least one third type of wire harness having a male connector with three male prongs, a first group of female terminal sockets, a second group of female terminal sockets, and conducting wires electrically connecting the three male prongs with the first and second groups of female terminal sockets respectively, the pair of male prongs of the male connector adapted for respective connection to the female connector base of another one of the plurality of vehicle light fixture, the first group of female terminal sockets adapted for respective connection of the second group of male terminal plugs of the at least one second type of wire harness.

Defined broadly, the present invention is a wire harness, comprising: (a) a connector having at least two contact members; (b) at least two first contact members respectively connected to the at least two contact members of the connector by a first conductor means; and (c) at least two second contact members respectively connected to the at least two contact members of the connector by a second conductor means.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A set of wire harnesses for the interconnection of a plurality of vehicle light fixtures, each vehicle light fixture having a female connector base thereon, the set of wire harnesses comprising:

a. at least one first type of wire harness having a male connector with a pair of male prongs, a pair of male terminal plugs, a pair of female terminal sockets, and conducting wires electrically connecting to the pair of male prongs with the pair of male terminal plugs and the pair of female terminal sockets respectively, the pair of male prongs adapted for respective connection to said female connector base of one of said plurality of vehicle light fixtures;

b. at least one second type of wire harness having a male connector with a pair of male prongs, a first pair of male terminal plugs, a second pair of male terminal plugs, and conducting wires electrically connecting the pair of male prongs of the at least one second type of wire harness with the first and second male terminal plugs respectively, the pair of male prongs of the male connector adapted for respective connection of said female connector base of another one of said plurality of vehicle light fixtures, the first pair of male terminal plugs adapted for respective connection of said pair of female terminal sockets of said at least one first type of wire harness; and c. at least one third type of wire harness having a male connector with a pair of male prongs, a first pair of female terminal sockets, a second pair of female terminal sockets, and conducting wires electrically connecting the pair of male prongs with the first and second female terminal sockets respectively, the pair of male prongs of the male connector adapted for respective connection to said female connector base of another one of said plurality of vehicle light fixture, the first pair of female terminal sockets adapted for respective connection of said second pair of male terminal plugs of said at least one second type of wire harness.

2. A set of wire harnesses for the interconnection of a plurality of vehicle light fixtures, each vehicle light fixture having a female connector base thereon, the set of wire harnesses comprising:

a. at least one first type of wire harness having a male connector with three male prongs, three male terminal plugs, three female terminal sockets, and conducting wires electrically connecting to the three male prongs with the three male terminal plugs and the three female terminal sockets respectively, the three male prongs adapted for respective connection to said female connector base of one of said plurality of vehicle light fixtures;

b. at least one second type of wire harness having a male connector with three male prongs, a first group of male terminal plugs, a second group of male terminal plugs, and conducting wires electrically connecting the three male prongs of the at least one second type of wire harness with the first and second groups of male terminal plugs respectively, the three male prongs of the male connector adapted for respective connection of said female connector base of another one of said plurality of vehicle light fixtures, the first group of male terminal plugs adapted for respective connection of said female terminal sockets of said at least one first type of wire harness; and c. at least one third type of wire harness having a male connector with three male prongs, a first group of female terminal sockets, a second group of female terminal sockets, and conducting wires electrically connecting the three male prongs with the first and second groups of female terminal sockets respectively, the pair of male prongs of the male connector adapted for respective connection to said female connector base of another one of said plurality of vehicle light fixture, the first group of female terminal sockets adapted for respective connection of said second group of male terminal plugs of said at least one second type of wire harness.

* * * * *